United States Patent [19]

Scott, Jr.

[11] Patent Number: 4,716,627

[45] Date of Patent: Jan. 5, 1988

[54] CRAB CRACKER

[76] Inventor: Winston C. Scott, Jr., Rte. Box 730 WS, Manderville, La. 70448

[21] Appl. No.: 902,669

[22] Filed: Nov. 10, 1986

[51] Int. Cl.[4] ..... A22C 29/00

[52] U.S. Cl. ..... 17/73; 17/68

[58] Field of Search ..... 17/68, 69, 70, 73; 30/120.2, 120.3, 120.4, 120.5; 81/418, 424.5, 426, 426.5

[56] References Cited

U.S. PATENT DOCUMENTS

| | | | |
|---|---|---|---|
| 198,678 | 12/1877 | Poole | 30/120.3 |
| D. 234,182 | 1/1975 | Mann et al. | 30/120.3 |
| 3,846,908 | 11/1974 | Allievi | 30/120.3 X |
| 4,103,395 | 8/1978 | Latorella | 17/71 |
| 4,519,136 | 5/1985 | Walker | 17/68 X |

*Primary Examiner*—Willie G. Abercrombie

[57] ABSTRACT

A hand operated, plier-like tool for cracking crabs and crab claws is provided, the tool having concaved portions in jaws for gripping and cracking the crabs or claws and the end of the tool defining a curved needle nose portion with teeth thereon for picking out exposed meat.

1 Claim, 2 Drawing Figures

CRAB CRACKER

This invention relates to a hand operated tool to crack and open crabs and crab claws, and to pick out meat of crabs. The tool is designed to crack the shell of claws and open crabs as not to damage the meat. It eliminates hammering with an object such as hammer or mallet, or even the blunt end of a knife or in some cases, teeth, to crack the shell. This is messy and damages the meat.

Another object is to provide a tool which opens crabs quickly and will expose the meat. A further objective of the tool is to remove the meat from the crab with the designed curved needle nose of the tool.

To achieve these and other objects the present invention provides a shell cracking and picking tool, comprising two handles, right and left with hinge pin in middle, which opens and closes like pliers with jaws that are notched and concaved to hold the crab claw, and crack when pressure is applied to the handles. The curved needle nose front of the tool has fine notches to grip. When they open and close like pliers they will extract the meat from the crab claws and the body of the crab. The tool or crab pliers have tapered flattened ends on each handle to allow you to insert between the shell. With a twisting motion it will open the crab and expose the meat.

The accompanying drawings are part of the specification and together with the description serves to explain the principles of the invention.

Figure 1:
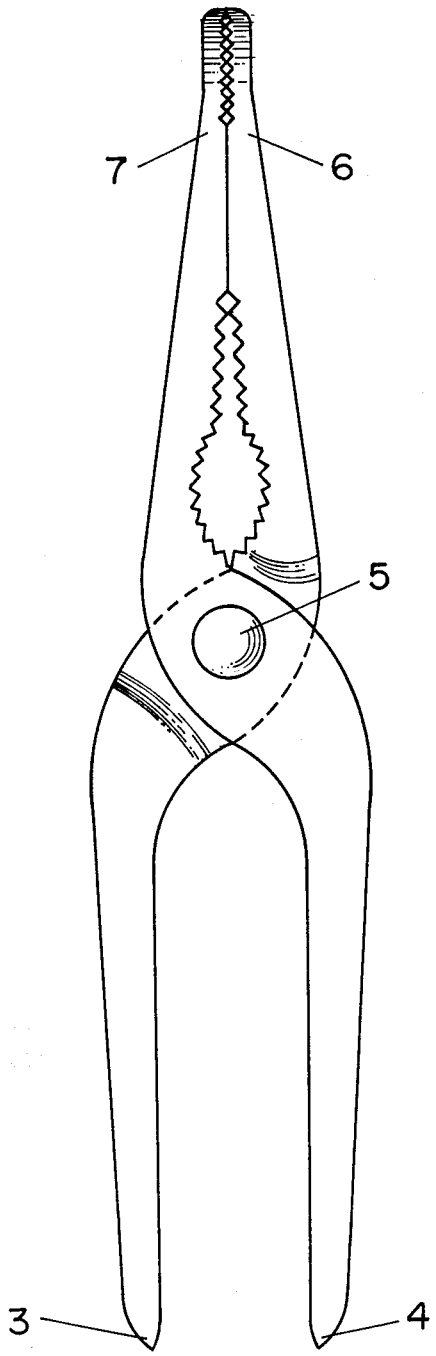
FIG. 1 is a top view of the tool in closed position.

Referring now to drawings, attention is first directed to FIG. 1. FIG. 1 shows the simplest form of the pliers for carrying out the method of the present invention.

Numeral 3 is the left handle. Numeral 4 is the right handle. Numeral 5 is a pin to hingedly join handle 3, and handle 4 together so it opens and closes like pliers.

Numeral 6 is a continuation of left handle 3, and numeral 7 is a continuation of handle 4, these portions defining jaws having concaved notches therein shaped to resemble a crab claw and to grip the same.

Figure 2:
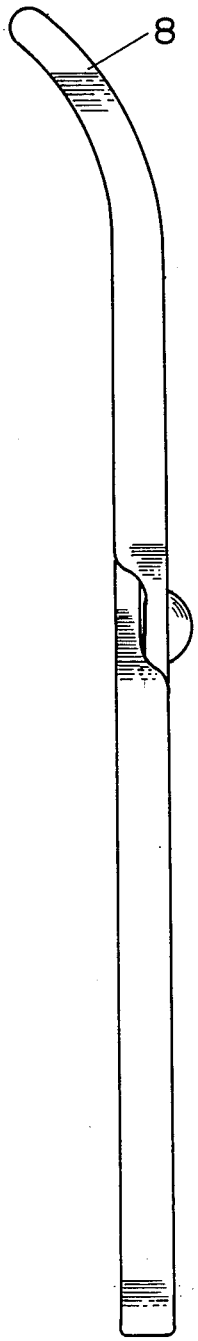
FIG. 2 is a side view of the tool to show the curve and needle nose of the pliers.

To operate the tool, one grips handles 3 and 4 after inserting a crab claw, applies pressure to crack the shell of the claw and thereby exposes the meat. The has a curved needle nose 8 as shown in FIG. 2 with fine notches to hold and grip the meat.

What is claimed is:

1. A crab cracking, opening and picking tool comprising a first handle having a concaved portion with notches therein and a curved needle nose portion with fine notches thereon, said needle nose portion being tapered and having a flattened end, a second handle having a concaved portion with notches therein and a curved needle nose portion with fine notches thereon, said needle nose portion being tapered and having a flattened end, said first and second handles being hingedly joined together to define a plier-like tool, said concaved portions of each defining, when the needle nose portions are in the substantially closed position, a crab claw-like concavity adapted to grip a crab or crab part to crack the shell thereof and the flatten ends being adapted to pick the exposed meat therefrom.

* * * * *